United States Patent [19]

Iwasaki et al.

[11] 4,234,378

[45] Nov. 18, 1980

[54] MAGNET PAPER SHEET AND A METHOD FOR MANUFACTURING THE SAME

[75] Inventors: Susumu Iwasaki, Sakai; Osamu Nagasawa; Tatsuo Takano, both of Osaka; Seiji Matsumoto, Sakai, all of Japan

[73] Assignee: Sakai Chemical Industry Co., Ltd., Osaka, Japan

[21] Appl. No.: 34,007

[22] Filed: Apr. 27, 1979

[30] Foreign Application Priority Data

Apr. 27, 1978 [JP] Japan ..... 53-51718

[51] Int. Cl.[3] ..... D21H 3/78

[52] U.S. Cl. ..... 162/138; 162/164 R; 162/164 EP; 162/168 R; 162/168 N; 162/168 NA; 162/169; 162/181 B

[58] Field of Search ..... 162/138, 181 R, 181 B, 162/164 R, 164 EP, 168 R, 168 N, 168 NA, 169

[56] References Cited

U.S. PATENT DOCUMENTS

| | | | |
|---|---|---|---|
| 2,547,948 | 4/1951 | Kornei | 162/181 B |
| 2,563,897 | 8/1951 | Wilson et al. | 162/138 |
| 4,116,752 | 9/1978 | Matsumoto et al. | 156/DIG. 74 |
| 4,121,966 | 10/1918 | Amano et al. | 162/169 |

FOREIGN PATENT DOCUMENTS

| | | |
|---|---|---|
| 41-16410 | 7/1966 | Japan . |
| 48-5006 | 1/1971 | Japan . |
| 49-111501 | 1/1973 | Japan . |

*Primary Examiner*—William F. Smith

*Attorney, Agent, or Firm*—Wenderoth, Lind & Ponack

[57] ABSTRACT

An improved method for manufacturing a magnet paper sheet which comprises: thoroughly mixing about 70–90 parts by weight of magnetoplumbite barium ferrite powder and/or magnetoplumbite strontium ferrite powder essentially consisting of particles of primary particle size of about 0.1–2 microns and of secondary particle size smaller than about 20 microns, an anionic synthetic latex containing about 1–10 parts by weight in dry weight of a synthetic rubber and/or a synthetic resin such as SBR, NBR, polyvinyl acetate and polyacrylate, about 2–10 weight % of a cationic organic polymer electrolyte such as polyamine and polyethyleneimine based on the amount of the synthetic rubber and/or resin, and more than about 5 parts by weight of pulp fibers together into a slurry; forming the slurry into a paper sheet; and magnetizing the paper sheet.

4 Claims, No Drawings

MAGNET PAPER SHEET AND A METHOD FOR MANUFACTURING THE SAME

The present invention relates to a magnet paper sheet and a method for manufacturing the same. More particularly, it relates to a paper sheet or a paper board having magnetoplumbite barium ferrite and/or magnetoplumbite strontium ferrite powder uniformly dispersed therein, and a method for manufacturing the same.

Various magnets in the form of sheet are now available, but they are directed to relatively limited applications due to the weight and price thereof. A most popular magnet sheet is a sheet of rubber or synthetic resin having magnetic powder dispersed therein. However, the magnet sheet of this type is very heavy and expensive so that they cannot be applied to a wide range of practical uses.

In usual paper making, the stock is formed into paper at a speed of several tens to several hundreds meters a minute on the Fourdrinier or the cylinder paper machine. Thus, when the magnet paper sheet is to be manufactured by the use of such a conventional paper machine on an industrial scale, it is desired that the stock therefor can be treated in the same manner as in the usual paper making. However, on the contrary to the stock for the usual paper making, the stock for the magnet paper sheet should contain a large amount of magnetic powder therein so as to produce the magnet paper sheet having a sufficiently great magnetic force or attractive force, and therefore, various difficulties are encountered with on manufacturing the magnet sheet applicable to practical uses. In particular, it is very difficult to keep a large amount of magnetic powder of a large specific gravity uniformly dispersed and fixed in a small amount of pulp fibers of a small specific gravity throughout the steps of paper making.

The magnet paper sheet per se is disclosed, for example, in Japanese Utility-model Publication No. 41-16410, Japanese Utility-model Disclosure Nos. 48-5006 and 49-111501, but the above difficulties still remain unsettled.

As is well known in the art, a sizing agent serves to fix a filler such as clay and titanium dioxide onto pulp fibers as well as to provide the paper thus manufactured with water repellency. Various sizing agents are now in use in the usual paper making, among which rosins are most widely used. The inventors, however, after extensive study on fixing or binding mechanism of sizing agents, have found that synthetic latex only satisfactorily serves for fixing a large amount of magnetic powder onto the paper forming fibers as well as for sizing the paper sheet thus formed. Furthermore, the inventors have found that an water soluble or emulsified polymer electrolyte greatly assists in fixing the sizing agent together with the magnetic powder onto the paper forming fibers.

It is, therefore, an object of the present invention, obviating the difficulties above mentioned, to provide an improved magnet paper sheet, or a magnet paper board, and a method for manufacturing the same.

Other objects and features of the present invention will be apparent from the following description with reference to preferred embodiments thereof.

According to the invention, there is provided a magnet paper sheet which comprises about 70–90 weight % of magnetoplumbite barium ferrite powder and/or magnetoplumbite strontium ferrite powder essentially consisting of particles of single crystalline particle size of 0.1–2 microns and of adhered and sintered particle size smaller than 20 microns, about 1–10 weight % of a synthetic rubber and/or a synthetic resin, about 2–10 parts by weight of water soluble or emulsified organic polymer electrolyte in relation to 100 parts by weight of the synthetic rubber and resin, and more than about 5 weight % of paper forming fibers.

The magnet paper sheet of the invention contains therein from about 70 weight % to about 90 weight %, preferably from about 80 weight % to about 85 weight %, of magnetoplumbite barium ferrite and/or magnetoplumbite strontium ferrite powder uniformly dispersed therein. In general, the magnetoplumbite ferrite has the general formula of $M^{2+}O.6Fe_2O_3$ wherein M represents a divalent metal. The magnetoplumbite barium ferrite and strontium ferrite have Ba and Sr as M, respectively, in the above formula.

Alnico magnet powder and rare earth metal-cobalt magnet powder are also candidates for the magnet powder used for manufacturing the magnet paper sheet. However, these metal powders have a great difficulty in dispersing uniformly in a slurry of the stock, and have a tendency to form sedimentation during the slurry formation. Furthermore, the magnetic powders are too expensive for the magnet paper sheet directed to practical uses, thus not suitable for use in the prerent invention.

The magnetoplumbite ferrite powder is in general produced by calcining single crystalline ferrite particles followed by crushing the calcined product. Therefore, the single crystalline particles, or the primary particles adhere to each other and are sintered to form secondary particles of a larger particle size during the calcination. The ferrite powder now afforded for use thus contains a relatively large amount of the secondary particles.

The ferrite powder suitably used in the invention has preferably a specified range of particle size. That is, the ferrite powder suitably used in the invention has individual single crystals in the single domain, and essentially consists of particles of about 0.1–2 microns, preferably about 0.2–1 microns, in single crystalline particle size (primary particle size), and smaller than about 20 microns, preferably about 10 microns, in adhered and sintered particle size (secondary particle size). The reason why the powder of the above particle size range is preferred is that the powder, when dispersed in a slurry of the stock, readily flocculates each other due to the mutual magnetic attraction through spontaneous magnetization of the particles, thus are uniformly fixed onto the paper forming fibers in the form of floccules. A preferred method for producing the ferrite powder having the above particle size is disclosed in, for example, U.S. Pat. Nos. 4,042,516 and 4,116,752 both to Matsumoto and Fukai.

The ferrite powder larger than about 20 microns in particle size tends to form sedimentation during the stock slurry preparation, and thus the stock retains only an insufficient amount of the powder therein, and provides the magnet paper sheet with a poor magnetic force. Furthermore, a portion of the powder of such a large particle size might fall off from the surface of the magnet paper sheet when the sheet is manufactured. On the other hand, the ferrite powder smaller than about 0.1 microns in particle size is no longer in the single domain, thus not having a sufficient magnetic force for the magnet paper sheet.

It is necessary that the magnet paper sheet of the invention contains more than about 70 weight % of the ferrite powder so as to have a sufficient attractive force for practical uses. However, it is practically difficult to retain the ferrite powder in an amount of more than about 90 weight % in the paper sheet. Furthermore, if containing more than about 90 weight % of the ferrite powder, the magnet paper sheet thus obtained will have rough surface and lose the nature and appearance as paper sheet. Excess ferrite powder might fall off from the surface of the sheet.

The magnet paper sheet of the invention further contains about 1–10 weight %, preferably about 2–5 weight %, of a synthetic rubber and/or a synthetic resin as a sizing agent for fixing the ferrite powder onto the paper forming fibers. When the amount of the sizing agent in solid in the magnet paper sheet is less than about 1 weight %, a sufficient amount of the ferrite powder is not retained in the paper forming fibers during the stock preparation, thus resulting in the product of a low quality. On the other hand, when the sizing agent is used in an amount of more than about 10 weight % in solid, the retention of the ferrite powder in the paper sheet is little improved, and thus the use of excess amount of the sizing agent is uneconomical. Furthermore, the excess amount of the sizing agent may clog screens and soil felts of a paper machine on paper making.

The synthetic rubber and/or the synthetic resin are added in the form of latex or emulsion to the stock slurry, and mixed therewith.

A wide variety of synthetic rubber latexes and synthetic resin emulsions, which will be hereinafter referred to as synthetic latexes, are used in the invention as a sizing agent and for fixing the ferrite powder onto the paper forming fibers. The synthetic latexes used in the invention include those of styrene-butadiene copolymer, acrylonitrile-butadiene copolymer, polyvinyl acetate, polyacrylate, acrylate-butadiene copolymer, acrylate-acrylonitrile copolymer, acrylate-styrene copolymer, vinyl acetate-acrylate copolymer, polyvinyl chloride, and ethylene-vinyl acetate copolymer.

The styrene-butadiene copolymer latex is one of the most suitably used latexes according to the invention. The copolymer contains about 20–90 weight % of styrene, preferably about 30–80 weight % of styrene. Most preferably, the copolymer contains about 40–70 weight % of styrene, that is, so-called high styrene SBR. The acrylonitrile-butadiene latex is also preferably used in the invention. The copolymer contains about 20–50 weight %, preferably about 25–45 weight % of acrylonitrile. Thus, so-called high nitrile NBR which contains about 25–45 weight % of acrylonitrile is preferably used in the invention. The synthetic latexes of homopolymers and copolymers of vinyl acetate and acrylate are also suitably used. Alkyl esters of 1–10 carbons, such as methyl, ethyl, propyl, butyl and 2-ethylhexyl esters of acrylic acid are suitable as acrylates. Among copolymers of the acrylates are, for example, acrylate-butadiene copolymer, preferably methyl methacrylate-butadiene copolymer containing about 20–60 weight % of methyl methacrylate, acrylate-acrylonitrile copolymer, acrylate-styrene copolymer, and acrylate-vinyl acetate copolymer, preferably containing about 10–50 weight %, most preferably about 15–30 weight %, of acrylate. If desired, polyvinyl chloride and ethylene-vinyl acetate copolymer latexes are used alone or together with other latexes above mentioned. If necessary, polystyrene and polyethylene latexes can be used together with other latexes. The latex is either nonionic or anionic, preferably, anionic since a cationic polymer polyelectrolyte is used for fixing the latex onto the fibers upon the stock preparation.

The sheet of the invention contains about 2–10 parts, preferably about 5–10 parts by weight of the electrolyte in relation to 100 parts by weight of the solid component in the latex. Preferred cationic electrolytes are for example cationic polyacrylamide, polyamine, polyamine- and polyamide-epichlohydrin condensation polymer, and polyethyleneimine. The polyamine includes condensates of alkylene dichlorides with alkylenepolyamines such as ethylenediamine, tetramethylenediamine and hexamethylenediamine, poly(N,N-dimethyl- and diethylaminomethacrylate), polyvinylimidazoline, polyvinylpyridine, cycloaddition polymer of diallylamine, coplymer of of N-vinylpyrolidone and acrylamide, and their quaternary salts such as halides and ammoniums.

As the paper forming fibers, any pulp can be used in the invention, among which are pulp of coniferous and deciduous trees, hemp, cotton, and waste paper. The pulp may or may not be bleached, but there is no need to use bleached pulp. Inorganic fibers such as asbesto fibers are also used alone or together with the above mentioned pulp. The magnet paper sheet of the invention contains more than about 5 weight % of the paper forming fibers, preferably about 5–15 weight % so as to fix and retain uniformly the ferrite powder in the fibers, and prevent the powder from falling off therefrom. It will be readily understood that the pulp or fibers should be beaten to a sufficient degree so as to have the ferrite powder uniformly dispersed therein. The ferrite powder is mixed with the fibers in a slurry either before or after beating of the pulp.

According to the invention, the magnet paper sheet is manufactured by throughly mixing about 70–90 parts by weight of magnetoplumbite barium ferrite and/or strontium ferrite essentially consisting of particles of primary particle size of about 0.1–2 microns and of secondary particle size smaller than about 20 microns, the synthetic latex containing about 1–10 parts by weight of synthetic rubber and/or synthetic resin in dry weight, about 2–10 weight % of water-soluble or emulsified organic polymer electrolyte based on the synthetic rubber and/or resin, more than about 5 parts by weight of the paper forming fibers in dry weight, and water together into a slurry, forming the slurry into a paper sheet, and then magnetizing the paper sheet.

In more detail, the stock slurry is prepared, for example, by dispersing the beaten pulp in water, the ferrite powder is added thereto, and then the pulp is further beaten, if necessary. Then, the cationic electrolyte is added to the resultant slurry while stirring. The electrolyte is added to the slurry as an aqueous solution, an aqueous emulsion or solid powder. After the addition, pH of the slurry is adjusted by adding thereto a mineral acid such as sulfuric acid in order to enhance the function of the electrolyte, and then the synthetic latex is added to the slurry while stirring, whereby are uniformly fixed onto the pulp together with the ferrite powder. The slurry is usually further diluted with water so that the solid concentration is about 1–6 weight %, preferably about 2–4 weight % before supplying to a paper machine.

In preparation of the stock slurry, other additives are added to the stock, if necessary, such as a dispersant, a viscosity arranging agent, a agent for promoting the peeling of a dried paper sheet from a dryer, etc. If desired, other sizing agents can be used together with the synthetic latex.

The slurry thus obtained is treated in the same manner as in the usual paper making. That is, the slurry is formed into a paper sheet by the use of a conventional paper machine such as the Fourdrinier, the cylinder, and the short wire paper machine. The thus formed paper sheet is, if desired, surface-sized, surface coated, or laminated with each other or other sheet of paper. The paper sheet is then cut into appropriate size and magnetized, or vice versa, to the magnet paper sheet of the invention. The magnetization is carried out by a conventional method. Usually one side only of the paper sheet is magnetized by striped multipole magnetization.

The magnet paper sheet of the invention is about 0.1–2 mm in thickness. It is practically difficult to manufacture a paper sheet thicker than about 2 mm by means of a conventional paper machine, and moreover, uneconomical. On the other hand, a paper sheet thinner than 0.1 mm cannot be provided with a sufficient attractive force by a conventional magnetization method. Accordingly, the paper sheet is so formed as to have a thickness from about 0.1 mm to 2 mm, preferably about 0.1–1 mm.

The magnet paper sheet of the invention, manufactured with a conventional paper machine at a low cost, has a sufficient magnetic force as well as nature and appearance as a paper sheet, and therefore, can be applied to a wide range of practical uses, for example, for drawing papers, posters, calendars, fixing pieces, electronic parts and others.

The invention will be understood more readily with reference to the following examples; however, these examples are intended to illustrate the invention, and are not to be construed to limit the scope of the invention.

EXAMPLE 1

64 Kg (dry weight) of 35°SR needle unbleached kraft pulp was dispersed in 6 Kl of water in a beater. To this dispersion was added 400 Kg of magnetoplumbite barium ferrite powder of average primary particle size of 0.4 microns and of average secondary particle size of 1.2 microns, containing substantially no particles larger than 20 microns in particle size, and the resultant mixture was further beaten for 20 minutes. After beating, the load by knives of a beater roll is removed, and the roll was rotated for stirring while 0.7 Kg (dry weight) of a cationic polyamine polyelectrolyte "Lufax 295" (sold by Rohm and Haas Company) was added to the mixture, and then 10 weight % solution of sulfuric acid was added thereto to lower pH of the slurry from 8 to 5. The synthetic latex, high nitrile NBR latex "Nipol 1561" (sold by Nihon Geon K.K.) containing 14 Kg (dry weight) of acrylonitrile-butadiene copolymer was then added to the slurry and stirred for 30 minutes to fix the latex onto the pulp together with the ferrite powder.

The stock slurry was further diluted with water so that the solid concentration thereof is about 3 weight %, and then formed into wet sheet, pressed, and dried to dried paper sheet of 1000 mm in width and 350 g/m$^2$ in basis weight at a speed of 10 m/min. by a short wire paper machine, with white water circulated as in the usual paper making. The thus formed paper sheet was on its one side only saturation-magnetized by striped multipole magnetizer having pole gap distance of 1.5 mm. The properties of the thus obtained magnet paper sheet are shown in TABLE.

EXAMPLES 2–5

The stocks having the formulation as shown in TABLE were formed into the magnet paper sheets, respectively, in the same manner as in EXAMPLE 1, and the properties thereof are also shown in TABLE.

REFERENCE EXAMPLE 1

64 Kg (dry weight) of 35°SR needle unbleached kraft pulp and 400 Kg of the same magnetoplumbite barium ferrite powder as used in EXAMPLE 1 were mixed in 6 Kl of water in a beater, followed by beating for 20 minutes in the same manner as in EXAMPLE 1. After beating, the load by knives of a beater roll is removed, and the roll was rotated for stirring while 12 Kg (dry weight) of rosin sizing agent "Sizepine E-K" (sold by Arakawa Kagaku Kogyo K.K.), and then 8 Kg (based on $Al_2O_3$) of aluminum sulfate or alum was added thereto to lower pH of the slurry to 4.5. The stock slurry was further diluted with water so that solid concentration is about 3 weight %, and formed into the magnet paper sheet in the same manner as in EXAMPLE 1. The properties of the magnet paper sheet are shown in TABLE.

REFERENCE EXAMPLE 2

64 Kg (dry weight) of the same pulp and 400 Kg of the same ferrite powder as used in EXAMPLE 1 were used together with 2.5 Kg of "Nipol 1561" and 0.12 Kg of "Lufax 295" to manufacture the magnet paper sheet in the same manner as in EXAMPLE 1. This example is to show that the use of an insufficient amount of the synthetic latex results in an insufficient retention of the ferrite powder, and accordingly a small magnetic force of the paper sheet.

TABLE

| | EXAMPLES | | | | | REFERENCE EXAMPLES | |
|---|---|---|---|---|---|---|---|
| | 1 | 2 | 3 | 4 | 5 | 1 | 2 |
| PULP (Kg, dry weight) | | | | | | | |
| Needle unbleached kraft | 64 | 64 | 30 | 40 | 64 | 64 | 64 |
| Waste paper | | 40 | | | | | |
| FERRITE (Kg) | | | | | | | |
| Barium ferrite | 400 | 360 | 400 | | 400 | 400 | 400 |
| Strontium ferrite | | | | 400 | | | |
| SIZING AGENT (Kg, dry weight) | | | | | | | |
| Sizepine E-K[1] | | | | | | 12 | |
| Nipol 1561[2] | 14 | | | | 7 | | 2.5 |
| Nipol LX-204[3] | | 20 | | | | | |
| Panflex OM-4000[4] | | | | 30 | | | |
| Primal B-15[5] | | | 14 | | | | |
| ELECTROLYTE (Kg, dry weight) | | | | | | | |

TABLE-continued

| | EXAMPLES | | | | | REFERENCE EXAMPLES | |
|---|---|---|---|---|---|---|---|
| | 1 | 2 | 3 | 4 | 5 | 1 | 2 |
| Alum (based on $Al_2O_3$) | | | | | | 8 | |
| Kymene 557[6] | | | 1.14 | | | | |
| Rufax 295[7] | 0.7 | 1.6 | | | 0.7 | | 0.12 |
| Epomin P-1000[8] | | | | 2.4 | | | |
| MAGNET PAPER SHEET | | | | | | | |
| Ferrite content (weight %) | 79.4 | 73.2 | 84.1 | 81.0 | 78.0 | 62.2 | 69.5 |
| Ferrite retention (%)[9] | 95.1 | 98.8 | 93.6 | 95.6 | 92.0 | 75.3 | 81.1 |
| Thickness (mm) | 0.30 | 0.29 | 0.30 | 0.32 | 0.30 | 0.27 | 0.29 |
| Average weight basis ($g/m^2$) | 350 | 350 | 355 | 350 | 348 | 300 | 345 |
| Attractive force ($g/cm^2$)[10] | 0.78 | 0.65 | 0.91 | 0.85 | 0.72 | 0.26 | 0.52 |

NOTES:
[1]Rosin size
[2]High acrylonitrile NBR latex (Nihon Geon K.K.)
[3]Medium styrene SBR latex (Nihon Geon K.K)
[4]Polyvinyl acetate emulsion (K.K. Kurare)
[5]Polyacrylate emulsion (Rohm and Haas Co.)
[6]Polyamide-epichlohydrin condensation polymer (Dick-Hercules Chemicals, Inc.)
[7]Polyamine (Rohm and Haas Co.)
[8]Polyethyleneimine (Nihon Shokubai Kogyo K.K.)
[9] $\frac{\text{\% Ferrite retained in the sheet}}{\text{\% Ferrite used for the stock}}$
[10]A magnet paper sheet 10 cm × 10 cm in area was put on a horizontal base, and a finished steel plate 8cm × 8 cm in are was put thereon. The force required for separating the plate from the magnet sheet by pulling the plate vertically.

What is claimed is:

1. A method for manufacturing a magnet paper sheet which comprises:

(a) adding to a slurry of paper forming fiber about 70–90 parts by weight of at least one ferrite powder selected from the group consisting of magnetoplumbite barium ferrite and magnetoplumbite strontium ferrite essentially consisting of particles of a primary particle size of about 0.1–2 microns and of secondary particle size smaller than about 20 microns;

(b) adding to the resultant slurry a cationic synthetic polymer electrolyte selected from the group consisting of a polyacrylamide, a polyamine, a polyamine-epichlohydrin condensation polymer and a polyethyleneimine;

(c) then adding to the resultant slurry of step (b) an anionic synthetic latex containing about 1–10 parts by weight of a synthetic polymer selected from the group consisting of a styrene-butadine copolymer, an acrylonitrile-butadiene copolymer, a polyvinyl acetate a polyacrylate, an acrylate-butadiene copolymer, an acrylate-acrylonitrile copolymer, an acrylate-styrene copolymer, a vinyl acetate-acrylate copolymer, a polyvinyl chloride, and an ethylene-vinyl acetate copolymer; the amount of the cationic synthetic polymer electrolyte being about 2–10% by weight of the dry weight of the anionic synthetic polymer latex;

(d) forming the thus obtained slurry into a paper sheet of about 0.1–2 mm in thickness; and (e) magnetizing the paper sheet.

2. A method for manufacturing a magnet paper sheet as claimed in claim 1 wherein the styrene-butadiene copolymer contains about 40–70% by weight of styrene.

3. A method for manufacturing a magnet paper sheet as claimed in claim 1 wherein the acrylonitrile-butadiene copolymer contains about 25–45% by weight of acrylonitrile.

4. A method for manufacturing a magnet paper sheet as claimed in claim 2 wherein the copolymer contains carboxyl groups therein.

* * * * *